US012070106B2

(12) United States Patent
Derrig

(10) Patent No.: US 12,070,106 B2
(45) **Date of Patent: *Aug. 27, 2024**

(54) METHOD FOR MAKING A JEWELRY RING

(71) Applicant: Frederick Goldman, Inc., Secaucus, NJ (US)

(72) Inventor: Andrew Derrig, Lynbrook, NJ (US)

(73) Assignee: Frederick Goldman, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/991,785

(22) Filed: Nov. 21, 2022

(65) Prior Publication Data

US 2023/0102691 A1 Mar. 30, 2023

Related U.S. Application Data

(62) Division of application No. 15/960,010, filed on Apr. 23, 2018, now Pat. No. 11,503,886, which is a (Continued)

(51) Int. Cl.
*A44C 27/00* (2006.01)
*A44C 9/00* (2006.01)
(Continued)

(52) U.S. Cl.
CPC ..... *A44C 27/006* (2013.01); *A44C 9/00* (2013.01); *C23C 28/321* (2013.01);
(Continued)

(58) Field of Classification Search
CPC ..... A44C 27/006; A44C 9/00; C23C 28/321; C23C 28/322; C23C 28/3225; C23C 28/34; C23C 28/347; C25D 7/005
See application file for complete search history.

(56) References Cited

U.S. PATENT DOCUMENTS 2,027,060 A 12/1899 Niven et al.
2,141,010 A 12/1938 Minister et al.
(Continued)

FOREIGN PATENT DOCUMENTS

DE 202006017385 1/2007
EP 0018432 11/1980
(Continued)

OTHER PUBLICATIONS

International Search Report and Written Opinion dated Sep. 29, 2011 in related PCT Application No. PCT/US11/39063 filed Jun. 3, 2011, 9 pages.
(Continued)

*Primary Examiner* — Rick K Chang
(74) *Attorney, Agent, or Firm* — Dentons US LLP

(57) ABSTRACT

Provided is a jewelry ring comprising a substrate, a first coating of a metallic nitride or a metallic boride, and an external metallic coating. Also provided is a metallic article comprising a substrate comprising tungsten carbide, cobalt, tungsten, titanium, titanium carbide, zirconium, tantalum or aluminum; a first coating of a metallic nitride or a metallic boride; and an external metallic coating. A method for making a jewelry ring comprising a substrate, a first coating of a metallic nitride or a metallic boride, and an external metallic coating is additionally provided. Further provided is a method for making a metallic article comprising a substrate comprising tungsten carbide, cobalt, tungsten, titanium, titanium carbide, zirconium, tantalum or aluminum; a first coating of a metallic nitride or a metallic boride; and an external metallic coating.

13 Claims, 1 Drawing Sheet

Related U.S. Application Data division of application No. 13/152,226, filed on Jun. 2, 2011, now Pat. No. 9,949,539.

(60) Provisional application No. 61/351,168, filed on Jun. 3, 2010.

(51) Int. Cl.
*C23C 28/00* (2006.01)
*C25D 7/00* (2006.01)

(52) U.S. Cl.
CPC ..... *C23C 28/322* (2013.01); *C23C 28/3225* (2013.01); *C23C 28/34* (2013.01); *C23C 28/347* (2013.01); *C25D 7/005* (2013.01)

(56) References Cited

U.S. PATENT DOCUMENTS

| | | | |
|---|---|---|---|
| 3,719,479 | A | 3/1973 | Flanagan et al. |
| 3,958,070 | A | 5/1976 | Schintlmeister et al. |
| 4,101,318 | A | 7/1978 | Rudy |
| 4,374,900 | A | 2/1983 | Hara et al. |
| 4,403,014 | A | 9/1983 | Bergmann |
| 4,505,746 | A | 3/1985 | Nakai et al. |
| 4,530,664 | A | 7/1985 | Prasad |
| 4,556,607 | A | 12/1985 | Sastri |
| 4,557,981 | A | 12/1985 | Bergmann |
| 4,591,418 | A | 5/1986 | Snyder |
| 4,636,252 | A | 1/1987 | Yoshimura et al. |
| 4,714,034 | A | 12/1987 | Riss |
| 4,745,035 | A | 5/1988 | Saurer et al. |
| 4,898,768 | A | 2/1990 | Randhawa |
| 4,943,486 | A | 7/1990 | Uchiyama |
| 4,973,388 | A | 11/1990 | Francois |
| 5,021,208 | A | 6/1991 | Ludwig |
| 5,776,408 | A | 7/1998 | Ghosh et al. |
| 5,853,826 | A | 12/1998 | Starcke et al. |
| 5,985,469 | A | 11/1999 | Kurakata et al. |
| 6,062,045 | A | 5/2000 | West |
| 6,319,460 | B1 | 11/2001 | Fang |
| 6,481,196 | B1 | 11/2002 | Chia et al. |
| 6,544,315 | B2 | 4/2003 | Har-Shai |
| 6,553,667 | B1 | 4/2003 | West |
| 6,641,640 | B1 | 11/2003 | Hesse |
| 6,767,418 | B1 | 7/2004 | Zhang et al. |
| 6,780,527 | B2 | 8/2004 | Naoi et al. |
| 6,884,466 | B2 | 4/2005 | Kaloyeros |
| 6,928,734 | B1 | 8/2005 | West |
| 6,936,117 | B1 | 8/2005 | Ishikawa |
| 6,990,736 | B2 | 1/2006 | West |
| 6,993,842 | B2 | 2/2006 | West |
| 7,032,314 | B2 | 4/2006 | West |
| 7,076,972 | B2 | 7/2006 | West |
| 7,137,275 | B2 | 11/2006 | Starcke et al. |
| 7,261,956 | B2 | 8/2007 | Kawakami et al. |
| 7,264,668 | B2 | 9/2007 | Lau et al. |
| 7,761,996 | B2 | 7/2010 | West |
| 8,003,225 | B2 | 8/2011 | Miya et al. |
| 8,061,033 | B2 | 11/2011 | West |
| 8,168,012 | B2 | 5/2012 | Steinemann |
| 8,178,222 | B2 | 5/2012 | Miya et al. |
| 9,949,539 | B2 * | 4/2018 | Derrig ..... C23C 28/3225 |
| 11,503,886 | B2 * | 11/2022 | Derrig ..... C25D 7/005 |
| 2003/0059634 | A1 | 3/2003 | Naoi |
| 2003/0134577 | A1 | 7/2003 | Coad |
| 2005/0166401 | A1 | 8/2005 | Robert |
| 2005/0208325 | A1 | 9/2005 | Kawakami |
| 2006/0008669 | A1 | 1/2006 | Chan |
| 2006/0051618 | A1 | 3/2006 | Festeau |
| 2007/0056778 | A1 | 3/2007 | Webb et al. |
| 2007/0254849 | A1 | 11/2007 | Chen |
| 2008/0241551 | A1 | 10/2008 | Zhang et al. |
| 2009/0041612 | A1 | 2/2009 | Fang et al. |
| 2009/0308102 | A1 | 12/2009 | Miller |
| 2010/0047618 | A1 | 2/2010 | Rostagno |
| 2010/0086756 | A1 | 4/2010 | Miya et al. |
| 2010/0261034 | A1 | 10/2010 | Cardarelli |
| 2010/0307671 | A1 | 12/2010 | David |
| 2010/0329920 | A1 | 12/2010 | Rosenberg |
| 2011/0218093 | A1 | 9/2011 | Xia |
| 2011/0296873 | A1 | 12/2011 | Derrig |
| 2012/0093675 | A1 | 4/2012 | Miller |

FOREIGN PATENT DOCUMENTS

| | | |
|---|---|---|
| EP | 1318204 | 6/2003 |
| GB | 2162864 | 2/1986 |
| JP | 5811783 | 1/1983 |
| JP | 03-120355 | 5/1991 |
| JP | 08013133 | 1/1996 |
| JP | 2007254849 | 10/2007 |

OTHER PUBLICATIONS

EP1318204, English translation by Patent Translate published Jun. 11, 2003, downloaded from European Patent Office on May 30, 2013, no English language corresponding application is available, 6 pages.
U.S. Appl. No. 10/042,007, filed Aug. 7, 2018, Brian P. Heber.
U.S. Appl. No. 11/042,003, filed Jun. 22, 2021, Philippe Coenegracht.
U.S. Appl. No. 11/121,980, filed Sep. 14, 2021, Moo-Ryong Ra.
U.S. Appl. No. 11/222,011, filed Jan. 11, 2022, Dayi Yang.
U.S. Appl. No. 11/271,990, filed Mar. 8, 2022, Reinhard Frank.
Europe Office Action dated Nov. 23, 2015 in related Application No. 12793978.3 filed Jun. 1, 2012 (4 pages).
Europe Office Action dated Nov. 23, 2015 in related Application No. 12793515.3 filed Jun. 1, 2012 (4 pages).
Europe Office Action dated Apr. 18, 2018 in related application 12793515.3 filed Jun. 1, 2012 (4 pages).
Europe Office Action dated Jun. 24, 2016 in related Application No. 12793978.3 filed Jun. 1, 2012 (5 pages).
Europe Office Action dated Jun. 24, 2016 in related Application No. 12793515.3 filed Jun. 1, 2012 (5 pages).
Europe Supplementary Search Report dated Feb. 11, 2015 in related Application No. 12793978.3 filed Jun. 1, 2012 (9 pages).
International Search Report and Written Opinion dated Aug. 21, 2012 in related International Application No. PCT/US2012/040415 filed Jun. 1, 2012 (7 pages).
International Search Report and Written Opinion dated Aug. 21, 2012 in related International Application No. PCT/US2012/040460 filed Jun. 1, 2012 (10 pages).
International Search Report and Written Opinion dated Aug. 27, 2012 in related International Application No. PCT/US2012/040356 filed Jun. 1, 2012 (14 pages).

* cited by examiner

METHOD FOR MAKING A JEWELRY RING

CROSS REFERENCE TO RELATED APPLICATIONS

The present application is a Divisional of U.S. Nonprovisional application Ser. No. 15/960,010 filed 23 Apr. 2018; which is a Divisional of U.S. Nonprovisional application Ser. No. 13/152,226 filed 2 Jun. 2011, now U.S. Pat. No. 9,949,539 issued 24 Apr. 2018; which claims the benefit of U.S. Provisional Application Ser. No. 61/351,168 filed 3 Jun. 2010; each of which is incorporated herein by reference in its entirety for all purposes.

BACKGROUND

The present application generally relates to metal or metallic articles such as jewelry or components for jewelry articles that are coated or plated with metal or metallic coatings.

Plating is a process where a thin layer of metal is deposited on the surface of a substrate. Metals are plated for various reasons, including for decoration, to harden, to alter conductivity, to inhibit corrosion, to reduce friction, to improve paint adhesion, to improve solderability, to improve wearability, and for radiation shielding. Gemstones can also be plated to provide improved color characteristics. See, e.g., U.S. Pat. No. 5,853,826.

Processes used in plating include electroplating, physical vapor deposition (PVD) and chemical vapor deposition (CVD). In electroplating, an electrical current is used to reduce cations of a coating material from a solution to coat a conductive substrate with a thin layer of the material. In PVD, a vaporized form of the coating metal is condensed in a vacuum onto the substrate surface. Vaporization and deposition of the coating metal can be effected by a number of methods known in the art, including evaporative deposition, electron beam physical vapor deposition, sputter deposition, cathodic arc deposition, pulsed laser deposition, and plasma-spray deposition. CVD involves exposing the substrate to a volatile precursor of the coating metal, which reacts or decomposes on the substrate surface.

While electroplating is the simplest process of plating a metal, electroplating is difficult or impossible where the substrate is a refractory metal such as tungsten, molybdenum, niobium, tantalum or rhenium. In particular tungsten and tungsten alloys such as tungsten carbide cannot be electroplated. Thus, a tungsten or tungsten alloy article such as an article of jewelry cannot be directly electroplated with, e.g., a layer of a precious metal such as gold, platinum or rhodium. This makes production of plated articles of a tungsten or tungsten alloy substrate difficult to produce. There is thus a need for new methods of making such articles. The present invention addresses that need.

SUMMARY

Provided is a jewelry ring comprising a substrate, a first coating of a metallic nitride or a metallic boride, and an external metallic coating.

Also provided is a metallic article comprising a substrate comprising tungsten carbide, cobalt, tungsten, titanium, titanium carbide, zirconium, tantalum or aluminum; a first coating of a metallic nitride or a metallic boride; and an external metallic coating.

A method for making a jewelry ring comprising a substrate, a first coating of a metallic nitride or a metallic boride, and an external metallic coating is additionally provided. The method comprises cutting, pressing, molding, casting, striking, extruding, sintering and/or shaping the substrate into a ring shape; depositing the first coating onto the substrate; and depositing the external metallic coating onto the first coating.

Further provided is a method for making a metallic article comprising a substrate comprising tungsten carbide, cobalt, tungsten, titanium, titanium carbide, zirconium, tantalum or aluminum; a first coating of a metallic nitride or a metallic boride; and an external metallic coating. The method comprises cutting, pressing, molding, casting, striking, extruding, sintering and/or shaping the substrate into a desired shape; depositing the first coating onto the substrate by physical vapor deposition or chemical vapor deposition; and depositing the external metallic coating onto the first coating.

The substrate, the first coating and the external metallic coating form a surface that is resistant to deformation and wear and substantially retains the color of the second coating material.

DETAILED DESCRIPTION

Figure 1:
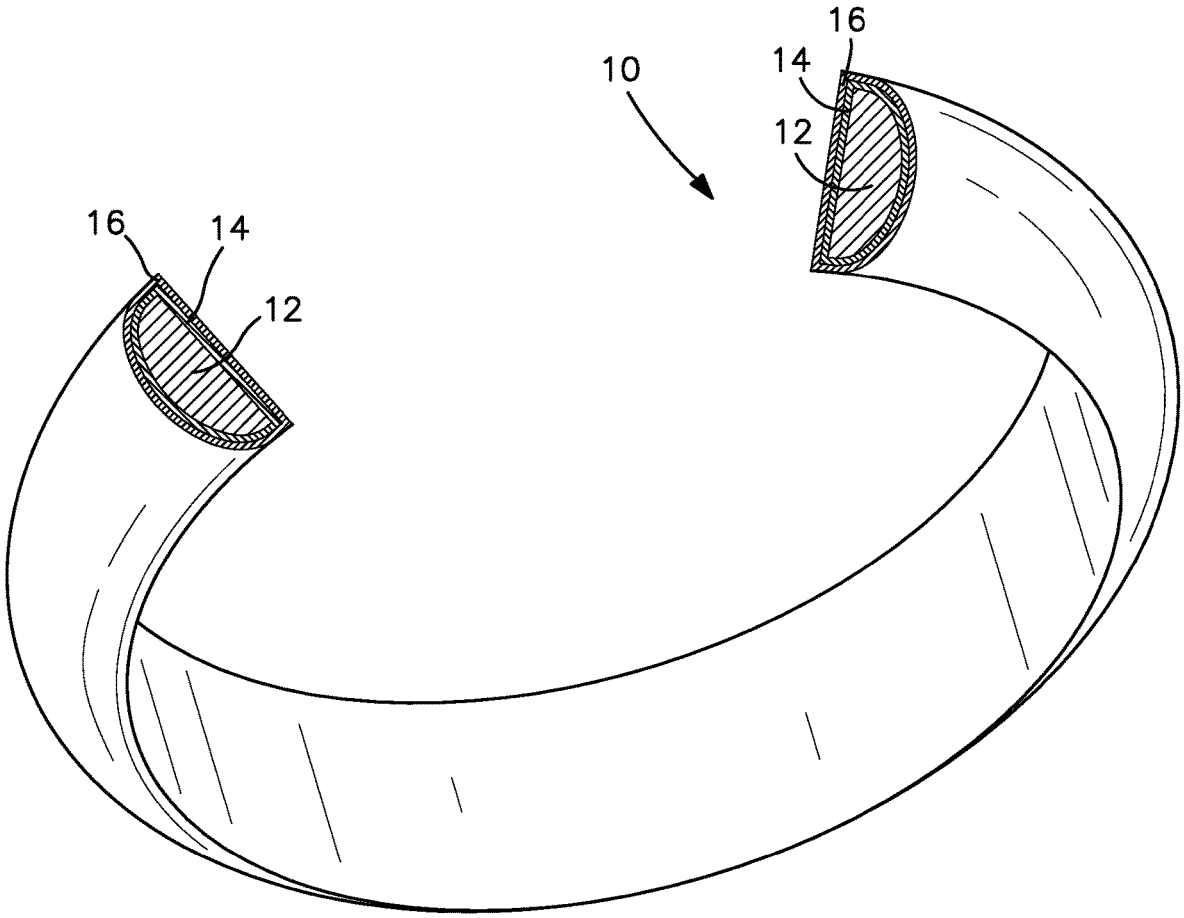
FIG. 1 shows a ring in accordance with an illustrative embodiment with a transverse cross-sectional cutout.

As used herein, the singular forms "a", "an" and "the" are intended to include the plural forms as well, unless the context clearly indicates otherwise. Additionally, the use of "or" is intended to include "and/or", unless the context clearly indicates otherwise.

For purposes of this disclosure and the claims herein, the term metallic includes metal. Described herein are articles having two metallic coatings. In various embodiments, the first metallic coating provides a substrate for electroplating the second, external metallic coating. Methods of making the articles are also described. The methods are particularly useful where the substrate upon which the two metallic coatings are applied is a refractory metal, such as tungsten carbide, that cannot be electroplated. The first metallic coating thus allows for electroplating of the refractory metal.

Thus, in some embodiments, a jewelry ring is provided. The ring comprises a substrate, a first coating of a metallic nitride or a metallic boride, and an external metallic coating. The substrate can be any material upon which a metallic nitride or a metallic boride can be deposited. In various embodiments, the substrate comprises a refractory metal such as tungsten, molybdenum, niobium, tantalum or rhenium. Such substrates generally cannot be electroplated. Thus, the first coating provides a surface upon which the external metallic coating can be electroplated. In certain embodiments, the substrate comprises tungsten carbide, cobalt, tungsten, titanium, titanium carbide, titanium-zirconium, zirconium, titanium-niobium-zirconium, stainless steel, molybdenum, niobium, tantalum, rhenium, aluminum, iridium, iron, 316 stainless steel, cobalt chrome, cobalt chromium, nickel, nitinol, aluminum carbide, vanadium, ruthenium, copper, tungsten copper, zinc, tin, hafnium, alloys of each of the foregoing or any combination thereof. Tungsten carbide is a particularly suitable substrate for these rings.

The first coating can be any metallic nitride or metallic boride. In some embodiments, the first coating is a metallic nitride or a metallic boride that can be subjected to electroplating. Examples include titanium nitride (TiN), titanium (2) nitride ($Ti_2N$), titanium carbo-nitride (TiCN), titanium-aluminum nitride (TiAlN), titanium-aluminum carbo-nitride (TiAlCN), chromium nitride (CrN), zirconium nitride (ZrN), chromium-titanium nitride (CrTiN), aluminum-titanium nitride (AlTiN), aluminum-titanium-chromium nitride (AlTiCrN), tungsten nitride (WN), titanium diboride ($TiB_2$), gold nitride, silver nitride, aluminum nitride, vanadium nitride or tantalum nitride. In particular embodiments, the first coating is titanium nitride. It is contemplated that the first coating is applied to the substrate using any physical vapor deposition process or chemical vapor deposition process.

Particularly suitable external metallic coatings for these rings are any material that can be electroplated onto the first coating. The external metallic coating may comprise a metal, a metallic compound, a metal alloy, a metal carbide, a metal nitride or a metal boride. In some embodiments, the external metallic coating comprises a material that imparts an attractive coloration to the ring, for example platinum, rhodium, palladium, ruthenium, gold, a gold alloy, silver, a silver alloy, zirconium, tungsten nitride, tungsten carbide, chrome, cobalt, tungsten, titanium, titanium carbide, tantalum, iridium, iron, stainless steel, 316 stainless steel, cobalt chrome, cobalt chromium, nickel, nitinol, aluminum, aluminum carbide, vanadium, copper, tungsten copper, zinc, tin, German silver, niobium, molybdenum, rhenium, hafnium, alloys of each of the foregoing and any combinations thereof. In particular embodiments, the external metallic coating is rhodium, which imparts a shiny whitish color to the ring.

For example, one specific embodiment of a ring comprises a tungsten carbide substrate, a titanium nitride first coating, and a rhodium external metallic coating.

The ring can be any size that can be utilized as, e.g., a finger ring, a toe ring or nose ring. Additionally, the ring can further comprise any other material used in jewelry affixed or integrated into the item. Examples include a precious metal (e.g., gold, silver, platinum) affixed to the item, a stone, a gemstone, a crystal, or any other material suitable for use in a ring affixed to the item.

Figure 2:
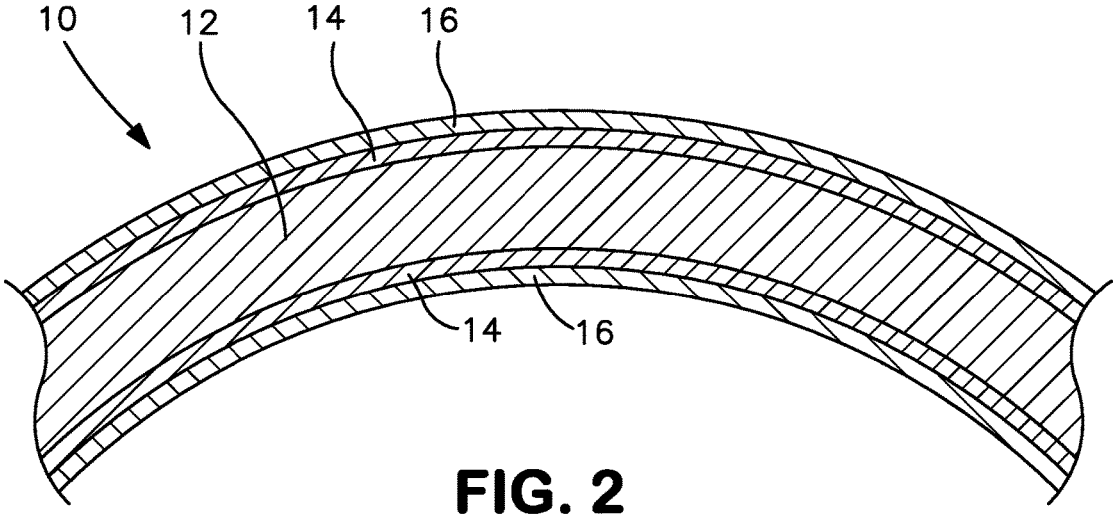
FIG. 2 is a longitudinal cross-section of a ring in accordance with an illustrative embodiment.

FIGS. 1 and 2 provide a transverse cutout (FIG. 1) and a longitudinal cross-section (FIG. 2) of a finger ring 10 in accordance with some embodiments. In these embodiments, the substrate 12 is coated with a first coating 14 and an external metallic coating 16. In the figures, the thicknesses of the first coating 14 and the external metallic coating 16 are not necessarily drawn to scale.

Also provided herein is a metallic article comprising a substrate comprising tungsten carbide, cobalt, tungsten, titanium, titanium carbide, zirconium, tantalum, aluminum, titanium-zirconium, titanium-niobium-zirconium, stainless steel, molybdenum, niobium, rhenium, iridium, iron, 316 stainless steel, cobalt chrome, cobalt chromium, nickel, nitinol, aluminum carbide, vanadium, ruthenium, copper, tungsten copper, zinc, tin, hafnium, alloys of each of the foregoing or any combination thereof; a first coating of a metallic nitride or a metallic boride; and an external metallic coating. As discussed in relation to the rings described above, the external metallic coating cannot be applied to tungsten carbide by electroplating, so the first coating provides a material upon which the external metallic coating can be so applied. Suitable examples of the first coating are TiN, $Ti_2N$, TiCN, TiAlN, TiAlCN, CrN, ZrN, CrTiN, AlTiN, AlTiCrN, WN, $TiB_2$, gold nitride, silver nitride, aluminum nitride, vanadium nitride or tantalum nitride. In particular embodiments, the first coating is titanium nitride. In various embodiments, the first coating is applied to the substrate using physical vapor deposition or chemical vapor deposition.

The external metallic coating can be any coating appropriate for the metallic article. Where a hard surface is desired, for example for an article that is subject to extensive wear, such as a portion of a picture frame, a paperweight, or a portion of a piece of furniture (e.g., an inlay) that may be abraded during use, the external metallic coating can be a hard material such as TiAlN, TiN, or $TiB_2$. In other embodiments, the external metallic coating comprises a material that imparts an attractive coloration to the article, for example platinum, rhodium, palladium, ruthenium, gold, a gold alloy, silver, a silver alloy, zirconium, tungsten nitride, tungsten carbide, chrome, cobalt, tungsten, titanium, titanium carbide, tantalum, iridium, iron, stainless steel, 316 stainless steel, cobalt chrome, cobalt chromium, nickel, nitinol, aluminum, aluminum carbide, vanadium, copper, tungsten copper, zinc, tin, German silver, niobium, molybdenum, rhenium, hafnium, alloys of each of the foregoing and any combinations thereof. To provide a white coloration to the article, a rhodium external metallic coating is useful. Other external metallic coating may comprise a metal, a metallic compound, a metal alloy, a metal carbide, a metal nitride or a metal boride.

In some embodiments, the article is an item of jewelry. Nonlimiting examples include a ring (e.g., a finger ring), a pendant, a dog tag, a hairclip, a chain, a watchcase, a pin, a bracelet, a necklace, an earring, a charm, ornamental ring, engagement ring, toe ring, watch, armlet, brocade, clip, fob, ornamental piercing, nose ring, amulet, bangle bracelet, cuff bracelet, link bracelet, cuff link, key chain, money clip, cell phone charm, signet ring, class ring, friendship ring or purity ring or a component any of the foregoing. In various embodiments, such articles further comprise at least one of a precious metal, a stone, a gemstone, a crystal, or another material suitable for use in jewelry affixed to the article.

A method for making a jewelry ring comprising a substrate, a first coating of a metallic nitride or a metallic boride, and an external metallic coating is additionally provided. The method comprises cutting, pressing, molding, casting, striking, extruding, sintering and/or shaping the substrate into a ring shape; depositing the first coating onto the substrate; and depositing the external metallic coating onto the first coating.

The cutting, pressing, molding, casting, striking, extruding, sintering and/or shaping of the substrate can utilize any process known in the art, for example using a vacuum arc furnace, plasma hearth melting, induction skull melting, free smithing, wire electric discharge machining (EDM), sink EDM, CNC lathe, and/or any polishing or engraving method known. Heat treatments may also be performed to impart desired characteristics to the ring.

In various embodiments, the first coating is deposited onto the substrate by physical vapor deposition or chemical vapor deposition. In additional embodiments, the external metallic coating is deposited onto the first coating using any known deposition technique, such as, for example, electroplating, PVD or CVD.

As described above, examples of a suitable substrate for the ring include tungsten carbide, cobalt, tungsten, titanium, titanium carbide, titanium-zirconium, zirconium, titanium-niobium-zirconium, stainless steel, molybdenum, niobium, tantalum, rhenium, aluminum, titanium-zirconium, titanium-niobium-zirconium, stainless steel, molybdenum, niobium, rhenium, iridium, iron, 316 stainless steel, cobalt chrome, cobalt chromium, nickel, nitinol, aluminum carbide, vanadium, ruthenium, copper, tungsten copper, zinc, tin, hafnium, alloys of each of the foregoing or any combination thereof. In particular embodiments, the substrate is tungsten carbide.

Also as discussed above, a particularly desirable first coating can be electroplated with the external metallic coating. Examples of a suitable first coating are TiN, $Ti_2N$, TiCN, TiAlN, TiAlCN, CrN, ZrN, CrTiN, AlTiN, AlTiCrN, WN, or $TiB_2$, gold nitride, silver nitride, aluminum nitride, vanadium nitride or tantalum nitride. In particular embodiments, the first coating is titanium nitride.

In various embodiments, the first coating is deposited onto the substrate by physical vapor deposition or chemical vapor deposition. In additional embodiments, the external metallic coating is deposited onto the first coating using any known deposition technique, such as, for example, electroplating, PVD or CVD.

Particularly suitable external metallic coatings for these rings are any material that can be electroplated onto the first coating, especially a material that imparts an attractive coloration to the ring, for example platinum, rhodium, palladium, ruthenium, gold, a gold alloy, silver, a silver alloy, zirconium, tungsten nitride, tungsten carbide, chrome, cobalt, tungsten, titanium, titanium carbide, tantalum, iridium, iron, stainless steel, 316 stainless steel, cobalt chrome, cobalt chromium, nickel, nitinol, aluminum, aluminum carbide, vanadium, copper, tungsten copper, zinc, tin, German silver, niobium, molybdenum, rhenium, hafnium, alloys of each of the foregoing and any combinations thereof. In particular embodiments, the external metallic coating is rhodium.

As with the rings discussed above, the ring in these embodiments can be any size that can be utilized as, e.g., a finger ring, a toe ring or nose ring. Additionally, the ring can further comprise any other material used in jewelry affixed or integrated into the item. Examples include a precious metal (e.g., gold, silver, platinum) affixed to the item, a stone, a gemstone, a crystal, or any other material suitable for use in a ring affixed to the item.

Further provided is a method for making a metallic article comprising a substrate comprising tungsten carbide, cobalt, tungsten, titanium, titanium carbide, zirconium, tantalum, aluminum, titanium-zirconium, titanium-niobium-zirconium, stainless steel, molybdenum, niobium, rhenium, iridium, iron, 316 stainless steel, cobalt chrome, cobalt chromium, nickel, nitinol, aluminum carbide, vanadium, ruthenium, copper, tungsten copper, zinc, tin, hafnium, alloys of each of the foregoing or any combination thereof; a first coating of a metallic nitride or a metallic boride; and an external metallic coating. The method comprises cutting, pressing, molding, casting, striking, extruding, sintering and/or shaping the substrate into a desired shape; depositing the first coating onto the tungsten carbide substrate by physical vapor deposition or chemical vapor deposition; and depositing the external metallic coating onto the first coating. In some embodiments, the first coating is deposited onto the substrate by physical vapor deposition or chemical vapor deposition. In particular embodiments, the first coating is deposited onto the substrate by physical vapor deposition.

In additional embodiments, the external metallic coating is deposited onto the first coating using electroplating.

Nonlimiting examples of suitable first coatings for these articles are TiN, $Ti_2N$, TiCN, TiAlN, TiAlCN, CrN, ZrN, CrTiN, AlTiN, AlTiCrN, WN, or $TiB_2$, gold nitride, silver nitride, aluminum nitride, vanadium nitride or tantalum nitride. In more particular embodiments, the first coating is titanium nitride.

In additional embodiments, examples of suitable external metallic coatings for these articles are platinum, rhodium, palladium, ruthenium, gold, a gold alloy, silver, a silver alloy, zirconium, tungsten nitride, tungsten carbide, chrome, cobalt, tungsten, titanium, titanium carbide, tantalum, iridium, iron, stainless steel, 316 stainless steel, cobalt chrome, cobalt chromium, nickel, nitinol, aluminum, aluminum carbide, vanadium, copper, tungsten copper, zinc, tin, German silver, niobium, molybdenum, rhenium, hafnium, alloys of each of the foregoing and any combinations thereof.

In various embodiments, the article is an item of jewelry. Nonlimiting examples include a ring (e.g., a finger ring), a pendant, a dog tag, a hairclip, a chain, a watchcase, a pin, a bracelet, a necklace, an earring, a charm, ornamental ring, engagement ring, toe ring, watch, armlet, brocade, clip, fob, ornamental piercing, nose ring, amulet, bangle bracelet, cuff bracelet, link bracelet, cuff link, key chain, money clip, cell phone charm, signet ring, class ring, friendship ring or purity ring or a component any of the foregoing. In various embodiments, such articles further comprise at least one of a precious metal, a stone, a gemstone, a crystal, or another material suitable for use in jewelry affixed to the article.

Other embodiments within the scope of the claims herein will be apparent to one skilled in the art from consideration of the specification or practice of the invention as disclosed herein. It is intended that the specification be considered exemplary only, with the scope and spirit of the invention being indicated by the claims.

In view of the above, it will be seen that the several advantages of the invention are achieved and other advantages attained.

As various changes could be made in the above methods and compositions without departing from the scope of the invention, it is intended that all matter contained in the above description and shown in the accompanying drawings shall be interpreted as illustrative and not in a limiting sense.

All references cited in this specification are hereby incorporated by reference. The discussion of the references herein is intended merely to summarize the assertions made by the authors and no admission is made that any reference constitutes prior art. Applicants reserve the right to challenge the accuracy and pertinence of the cited references.

The invention claimed is:

1. A method for making a metallic article comprising a substrate comprising tungsten carbide, cobalt, tungsten, titanium, titanium carbide, zirconium, tantalum, aluminum, titanium-zirconium, titanium-niobium-zirconium, stainless steel, molybdenum, niobium, rhenium, iridium, iron, 316 stainless steel, cobalt chrome, cobalt chromium, nickel, nitinol, aluminum carbide, vanadium, ruthenium, copper, tungsten copper, zinc, tin, or hafnium, or alloys of each of the foregoing; a first coating of a metallic nitride or a metallic boride; and an external metallic coating, the method comprising forming the substrate into a desired shape;

depositing the first coating onto the substrate; and depositing the external metallic coating onto the first coating, the external metallic coating surrounding the first coating such that the external metallic coating is outermost, wherein the external metallic coating includes at least one item from at least one of group (a) chromium-titanium nitride (CrTiN), aluminum-titanium nitride (AlTiN), aluminum-titanium-chromium nitride (AlTiCrN), tungsten nitride (WN), tungsten carbide, tungsten, zirconium, cobalt chrome, cobalt chromium, nitinol, aluminum carbide, vanadium, copper, brass, bronze, tungsten copper, zinc, tin, German silver, niobium, molybdenum, hafnium, rhenium, chromium, silver nitride, aluminum nitride, vanadium nitride, tantalum nitride, tantalum carbide, and cobalt chrome molybdenum, or any combination thereof, or (b) cobalt and tantalum, excluding gold (au).

2. The method of claim 1, wherein the first coating is deposited onto the substrate by physical vapor deposition or chemical vapor deposition.

3. The method of claim 1, wherein the external metallic coating is deposited onto the first coating using electroplating, PVD or CVD.

4. The method of claim 1, wherein the first coating is titanium nitride (TiN), titanium(2) nitride ($Ti_2N$), titanium carbo-nitride (TiCN), titanium-aluminum nitride (TiAlN), titanium-aluminum carbo-nitride (TiAlCN), chromium nitride (CrN), zirconium nitride (ZrN), chromium-titanium nitride (CrTiN), aluminum-titanium nitride (AlTiN), aluminum-titanium-chromium nitride (AlTiCrN), tungsten nitride (WN), titanium diboride ($TiB_2$), gold nitride, silver nitride, aluminum nitride, vanadium nitride or tantalum nitride.

5. The method of claim 4, wherein the first coating is titanium nitride.

6. The method of claim 5, wherein the external metallic coating comprises rhodium.

7. The method of claim 1, wherein the external metallic coating further comprises at least one of platinum, rhodium, palladium, ruthenium, silver, a silver alloy, zirconium, tungsten nitride, chrome, tungsten, titanium, titanium carbide, tantalum, iridium, cobalt chrome, cobalt chromium, nickel, nitinol, aluminum carbide, vanadium, tungsten copper, zinc, tin, German silver, niobium, molybdenum, rhenium, hafnium, alloys of each of the foregoing or any combinations thereof.

8. The method of claim 1, wherein the external metallic coating comprises rhodium.

9. The method of claim 1, wherein the article is an item of jewelry.

10. The method of claim 9, wherein the item of jewelry is a ring, pendant, dog tag, hairclip, chain, watchcase, pin, bracelet, necklace, earring, charm, ornamental ring, engagement ring, toe ring, watch, armlet, brocade, clip, fob, ornamental piercing, nose ring, amulet, bangle bracelet, cuff bracelet, link bracelet, cuff link, key chain, money clip, cell phone charm, signet ring, class ring, friendship ring or purity ring or a component any of the foregoing.

11. The method of claim 9, wherein the item of jewelry is a finger ring.

12. A method for making a jewelry ring comprising a substrate, a first coating of a metallic nitride or a metallic boride, and an external metallic coating, the method comprising forming the substrate into a ring shape;

depositing the first coating onto the substrate; and depositing the external metallic coating onto the first coating, the external metallic coating surrounding the first coating such that the external metallic coating is outermost, wherein the external metallic coating includes at least one item from at least one of group (a) chromium-titanium nitride (CrTiN), aluminum-titanium nitride (AlTiN), aluminum-titanium-chromium nitride (AlTiCrN), tungsten nitride (WN), tungsten carbide, tungsten, zirconium, cobalt chrome, cobalt chromium, nitinol, aluminum carbide, vanadium, copper, brass, bronze, tungsten copper, zinc, tin, German silver, niobium, molybdenum, hafnium, rhenium, chromium, silver nitride, aluminum nitride, vanadium nitride, tantalum nitride, tantalum carbide, and cobalt chrome molybdenum, or any combination thereof, or (b) cobalt and tantalum, excluding gold (au).

13. A method for making a metallic article consisting of a substrate, a first coating of a metallic nitride or a metallic boride, and an external metallic coating, the method comprising:

forming the substrate into a ring shape;

depositing the first coating onto the substrate; and depositing the external metallic coating onto the first coating, the external metallic coating surrounding the first coating such that the external metallic coating is outermost, wherein the external metallic coating includes at least one item from at least one of group (a) chromium-titanium nitride (CrTiN), aluminum-titanium nitride (AlTiN), aluminum-titanium-chromium nitride (AlTiCrN), tungsten nitride (WN), tungsten carbide, tungsten, zirconium, cobalt chrome, cobalt chromium, nitinol, aluminum carbide, vanadium, copper, brass, bronze, tungsten copper, zinc, tin, German silver, niobium, molybdenum, hafnium, rhenium, chromium, silver nitride, aluminum nitride, vanadium nitride, tantalum nitride, tantalum carbide, and cobalt chrome molybdenum, or (b) cobalt and tantalum.

* * * * *